US005680702A

United States Patent [19]

Kataoka

[11] Patent Number: 5,680,702

[45] Date of Patent: Oct. 28, 1997

[54] METHOD FOR MANUFACTURING INK JET HEADS

[75] Inventor: Masaki Kataoka, Kanagawa, Japan

[73] Assignee: Fuji Xerox Co., Ltd., Tokyo, Japan

[21] Appl. No.: 515,213

[22] Filed: Aug. 15, 1995

[30] Foreign Application Priority Data

Sep. 19, 1994 [JP] Japan ..... 6-223757

[51] Int. Cl.[6] ..... B41J 2/16; B26D 3/12

[52] U.S. Cl. ..... 29/890.1; 29/416; 29/417

[58] Field of Search ..... 29/416, 417, 890.1; 83/33, 42, 49, 52; 125/901, 13.01, 14; 347/40, 47

[56] References Cited

U.S. PATENT DOCUMENTS

| | | | |
|---|---|---|---|
| 4,047,186 | 9/1977 | Kendall et al. | 29/890.1 X |
| 4,301,585 | 11/1981 | Ikeda | 29/890.1 |
| 5,057,853 | 10/1991 | Fisher | 29/890.1 X |
| 5,193,256 | 3/1993 | Ochiai et al. | 29/416 X |
| 5,218,754 | 6/1993 | Rangappan | 29/890.1 X |
| 5,365,645 | 11/1994 | Walker et al. | 29/890.1 X |
| 5,408,739 | 4/1995 | Altavela et al. | 83/33 X |
| 5,479,685 | 1/1996 | Shimokata et al. | 29/890.1 X |

FOREIGN PATENT DOCUMENTS

| | | | |
|---|---|---|---|
| 61-230954 | 10/1961 | Japan . | |
| 60-196354 | 10/1985 | Japan . | |
| 1-166965 | 6/1989 | Japan . | |
| 2-184451 | 7/1990 | Japan . | |
| 3-281170 | 12/1991 | Japan . | |
| 4-234666 | 8/1992 | Japan . | |
| 4-234667 | 8/1992 | Japan . | |
| 4-257405 | 9/1992 | Japan . | |
| 4357041 | 12/1992 | Japan | 29/890.1 |
| 5-57897 | 3/1993 | Japan . | |
| 5155030 | 6/1993 | Japan | 29/890.1 |

*Primary Examiner*—Peter Vo

*Attorney, Agent, or Firm*—Finnegan, Henderson, Farabow, Garrett & Dunner, L.L.P.

[57] ABSTRACT

In a dicing step in which a spout face is formed and a flow path length is defined, for example, a region in a cut depth direction is divided into a cutting region B containing spouts, a region A above the region B, and a region C below the region B. Feedrate v2 when the region B is cut is applied for cutting head material with high quality. Feedrate v1 when the region A is cut is set to, for example, three times the feedrate v2 when the region B is cut, and the blade form is shaped at the feedrate v2. Feedrate v3 when the region C is cut is the same as the feedrate v2 when the region B is cut, whereby affecting the upper cut face is prevented and the yield is improved.

10 Claims, 12 Drawing Sheets

FIG. 12

| MANUFACTURING METHOD | GRINDING WATER SUPPLY METHOD | GRINDING TIME | FLOW PATH LENGTH ACCURACY | YIELD |
|---|---|---|---|---|
| CONVENTIONAL 1-STEP EXAMPLE | CONVENTIONAL EXAMPLE 1.5 ℓ /min | 39 sec/head | ±10 μm | 70% |
| CONVENTIONAL MULTI-STEP EXAMPLE | CONVENTIONAL EXAMPLE 1.5 ℓ /min | 30 sec/head | ±10 μm | 70% |
| EMBODIMENT 1 OF THE INVENTION | THE INVENTION 1.5 ℓ /min | 23.3 sec/head | -2 ~ +6 μm | 92% |
| EMBODIMENT 2 OF THE INVENTION | THE INVENTION 1.5 ℓ /min | 23 sec/head | -2 ~ +4 μm | 98% |
| EMBODIMENT 3 OF THE INVENTION | CONVENTIONAL EXAMPLE 1.5 ℓ /min | 23 sec/head | -2 ~ +4 μm | 85% |

FIG. 15

| U $\left(\times 10^{-6} \frac{mm^3 \cdot sec}{mm^2 \cdot sec}\right)$ | NO. OF REVOLUTIONS (rpm) | CUT DEPTH ($\mu$m) | FEEDRATE (mm/sec) | BLADE DIAMETER | SPOUT QUALITY | BLADE WEAR FORM |
|---|---|---|---|---|---|---|
| 0.37 | 40000 | 400 | 0.1 | 52 | ○× | × |
| 0.51 | 30000 | 400 | 0.1 | 50 | ○× | × |
| 1.15 | 30000 | 450 | 0.2 | 50 | ○ | × |
| 1.64 | 40000 | 400 | 0.5 | 52 | ○ | × |
| 1.91 | 40000 | 400 | 0.5 | 50 | ○ | × |
| 1.93 | 40000 | 420 | 0.5 | 52 | ○ | × |
| 2.01 | 40000 | 420 | 0.5 | 50 | ○ | × |
| 2.45 | 30000 | 400 | 0.5 | 52 | ○ | × |
| 2.55 | 30000 | 400 | 0.5 | 50 | ○ | × |
| 2.57 | 30000 | 420 | 0.5 | 52 | ○ | × |
| 2.68 | 30000 | 420 | 0.5 | 50 | ○ | × |
| 3.21 | 40000 | 350 | 1 | 52 | ○ | × |
| 3.34 | 40000 | 350 | 1 | 50 | ○ | × |
| 3.67 | 20000 | 400 | 0.5 | 52 | ○ | × |
| 3.82 | 20000 | 400 | 0.5 | 50 | ○ | × |
| 3.86 | 20000 | 420 | 0.5 | 52 | ○ | × |
| 3.86 | 40000 | 420 | 1 | 52 | ○ | × |
| 4.01 | 20000 | 420 | 0.5 | 50 | ○ | × |
| 4.29 | 30000 | 350 | 1 | 52 | ○ | × |
| 4.46 | 30000 | 350 | 1 | 50 | ○ | × |
| 5.14 | 30000 | 420 | 1 | 52 | ○ | × |
| 5.35 | 30000 | 420 | 1 | 50 | ○ | × |
| 6.43 | 20000 | 350 | 1 | 52 | ○ | × |
| 6.69 | 20000 | 350 | 1 | 50 | ○ | × |
| 7.72 | 40000 | 420 | 2 | 52 | ○ | × |
| 7.72 | 20000 | 420 | 1 | 52 | ○ | × |
| 8.03 | 20000 | 420 | 1 | 50 | ○ | × |
| 8.03 | 40000 | 420 | 2 | 50 | ○ | × |
| 8.58 | 30000 | 350 | 2 | 52 | ○ | × |
| 8.92 | 30000 | 350 | 2 | 50 | ○ | × |
| 9.19 | 40000 | 100 | 10 | 52 | × | ○ |
| 10.3 | 30000 | 420 | 2 | 52 | ○ | × |

FIG. 16

| U $\left(\times 10^{-6} \frac{mm^3 \cdot sec}{mm^2 \cdot sec}\right)$ | NO. OF REVOLUTIONS (rpm) | CUT DEPTH ($\mu$m) | FEEDRATE (mm/sec) | BLADE DIAMETER | SPOUT QUALITY | BLADE WEAR FORM |
|---|---|---|---|---|---|---|
| 10.7 | 30000 | 420 | 2 | 50 | ○ | × |
| 12.9 | 20000 | 350 | 2 | 52 | ○ | × |
| 13.4 | 20000 | 350 | 2 | 50 | ○ | × |
| 14.9 | 40000 | 180 | 9 | 52 | × | ○ |
| 15.4 | 20000 | 420 | 2 | 52 | △ | △ |
| 15.5 | 40000 | 180 | 9 | 50 | × | ○ |
| 16.1 | 20000 | 420 | 2 | 50 | × | × |
| 17.8 | 30000 | 350 | 4 | 50 | × | × |
| 18.4 | 40000 | 100 | 20 | 52 | × | ○ |
| 19.1 | 40000 | 100 | 20 | 50 | × | ○ |
| 19.3 | 40000 | 350 | 6 | 52 | × | ○ |
| 19.8 | 30000 | 180 | 9 | 52 | × | ○ |
| 20.1 | 40000 | 350 | 6 | 50 | × | ○ |
| 20.6 | 30000 | 180 | 9 | 50 | × | ○ |
| 25.7 | 40000 | 350 | 8 | 52 | × | ○ |
| 25.7 | 30000 | 350 | 6 | 52 | × | ○ |
| 26.8 | 30000 | 350 | 6 | 50 | × | ○ |
| 26.8 | 40000 | 350 | 8 | 50 | × | ○ |
| 29.8 | 20000 | 180 | 9 | 52 | × | ○ |
| 31.0 | 20000 | 180 | 9 | 50 | × | ○ |
| 32.2 | 40000 | 350 | 10 | 52 | × | ○ |
| 33.4 | 40000 | 350 | 10 | 50 | × | ○ |
| 34.3 | 30000 | 350 | 8 | 52 | × | ○ |
| 35.7 | 30000 | 350 | 8 | 50 | × | ○ |
| 36.6 | 20000 | 350 | 6 | 52 | × | ○ |
| 40.1 | 20000 | 350 | 6 | 50 | × | ○ |
| 42.9 | 30000 | 350 | 10 | 52 | ×× | ×× |
| 44.5 | 30000 | 350 | 10 | 50 | ×× | ×× |
| 51.4 | 20000 | 350 | 8 | 52 | × | ○ |
| 53.5 | 20000 | 350 | 8 | 50 | × | ○ |
| 64.3 | 20000 | 350 | 10 | 52 | ×× | ×× |
| 66.9 | 20000 | 350 | 10 | 50 | ×× | ×× |

FIG. 17

| U $\left(\times 10^{-7} \frac{mm^3 \cdot sec}{mm^2 \cdot sec}\right)$ | NO. OF REVOLUTIONS (rpm) | CUT DEPTH ($\mu$m) | FEEDRATE (mm/sec) | BLADE DIAMETER | SPOUT QUALITY | BLADE WEAR FORM |
|---|---|---|---|---|---|---|
| 0.44 | 30000 | 400 | 0.01 | 58 | ○ | × |
| 1.15 | 30000 | 450 | 0.02 | 50 | ○ | × |
| 1.91 | 40000 | 400 | 0.05 | 50 | ○ | × |
| 2.01 | 40000 | 420 | 0.05 | 50 | ○ | × |
| 2.55 | 30000 | 400 | 0.05 | 50 | ○ | × |
| 3.29 | 30000 | 300 | 0.1 | 58 | ○ | × |
| 3.84 | 40000 | 350 | 0.1 | 58 | ○ | × |
| 4.01 | 20000 | 420 | 0.05 | 50 | ○ | × |
| 4.46 | 30000 | 350 | 0.1 | 50 | ○ | × |
| 5.35 | 30000 | 420 | 0.1 | 50 | ○ | × |
| 6.69 | 20000 | 350 | 0.1 | 50 | ○ | × |
| 8.03 | 40000 | 420 | 0.2 | 50 | ○ | × |
| 8.92 | 30000 | 350 | 0.2 | 50 | ○ | × |
| 8.24 | 40000 | 100 | 1.0 | 58 | △ | × |
| 13.4 | 20000 | 350 | 0.2 | 50 | ○ | × |
| 15.4 | 20000 | 420 | 0.2 | 52 | △ | × |
| 16.1 | 20000 | 420 | 0.2 | 50 | × | × |
| 19.1 | 40000 | 100 | 2.0 | 50 | × | ○ |
| 20.6 | 30000 | 180 | 0.9 | 50 | × | ○ |
| 26.8 | 30000 | 350 | 0.6 | 50 | × | ○ |
| 46.1 | 20000 | 350 | 0.8 | 58 | × | ○ |
| 66.9 | 20000 | 350 | 1.0 | 50 | × | ○ |
| 86.5 | 40000 | 350 | 3.0 | 58 | ×× | ×× |

METHOD FOR MANUFACTURING INK JET HEADS

BACKGROUND OF THE INVENTION

This invention relates to a method for manufacturing ink jet heads and in particular to a cutting process for defining an ink flow path length with high accuracy and forming a high-quality nozzle.

Various ink jet head manufacturing methods have been proposed. A method whereby a large number of heads are formed on a large-area substrate and cut and separated is possible as a useful method for mass production, reducing costs, and stabilizing quality. Particularly, a method whereby two silicon wafers are bonded together and diced for providing a large number of uniform ink jet heads is en extremely useful method for mass production, reducing costs, and stabilizing quality. Such manufacturing methods are described, for example, in Japanese Patent Laid-Open No. Sho 61-230954, No. Hei 1-166965, etc.

Dicing (cutting work) is used for cutting a wafer into ink jet heads as a common technique to such ink jet head manufacturing methods. At many ink jet head structures, the nozzle face and nozzle greatly affecting ink drop jet directionality are machined and formed and a jet characteristic, particularly the ink flow path length greatly affecting the ink drop volume is determined by dicing. Thus, various dicing methods have been proposed.

For example, in the art described in Japanese Patent Laid-Open No. Sho 60-196354, the cutting process is divided into two steps or more for execution conforming to head material. A dicing method wherein the peripheral speed determined by the diameter and rotation speed of a blade used with dicing is made given speed or higher is described in Japanese Patent Laid-Open No. Hei 2-184451. A method wherein the parts to be made nozzles are grooved before substrates are bonded, and then the substrates are bonded and separated into ink jet heads at the grooves is described in Japanese Patent Laid-Open No. Hei 5-57897. A method wherein the resin layer of nozzle parts is pattern-etched before substrates are bonded and separated into ink jet heads is described in Japanese Patent Laid-Open No. Hei 4-234666. A method wherein the resin layer of nozzle parts is pattern-etched and then the parts to be made nozzles other than the resin layer are grooved before substrates are bonded and separated into ink jet heads at the grooves is described in Japanese Patent Laid-Open No. Hei 4-234667. The arts are intended for economically manufacturing heads good in dimension accuracy without broken nozzles.

Blades capable of accurate machining are used for ink jet head dicing because the dicing affects the ink flow path length and nozzle form as described above. Resin blades comprising diamond of an extremely small diameter coated with resin are generally used. However, the resin blade is soft and will gradually deform during cutting work and cause an error to occur in cutting positions.

In the art described in Japanese Patent Laid-Open No. Sho 60-196354, simply cutting is repeated several times; if a soft resin blade is used to provide high-quality spouts, the cutting positions cannot be held highly accurate over a cutting process on a large number of lines. In the art described in Japanese Patent Laid-Open No. Hei 5-57897, high-quality, high-accuracy cutting can be accomplished, but unless two substrates are bonded accurately, the upper or lower part of a spout shifts, affecting the ink spouting direction, which will introduce a problem particularly at high-density heads of 600 dpi; the bonding technique is at stake.

In the methods described in Japanese Patent Laid-Open Nos. Hei 4-234666 and 4-234667 mentioned above wherein the resin layer of nozzle parts is pattern-etched before the parts to be made nozzle surroundings other than the resin layer are diced, the resin layer is not cut, thus the blade is not clogged and a burr caused by cutting at the resin layer does not exist, providing good spouts. However, a shift corresponding to dicing position accuracy occurs between the end of the resin layer pattern-etched at the spout and the substrate end formed by cutting; the level difference as much as the resin layer thickness occurs at the spout. This level difference introduces a problem particularly at high-density heads of 600 dpi; the dicing position accuracy involves a problem.

In the art described in Japanese Patent Laid-Open No. Hei 2-184451, high-quality spouts can be provided at the initial stage by defining the peripheral speed of the blade. However, to produce a large number of heads by dicing, the resin blade gradually deforms and quality and accuracy lower at the later stage. The conditions achieving the quality are involved in the cut depth, feedrate, and grinding water, and are hard to be defined only by the peripheral speed of the blade.

Machining techniques other than ink jet heads, wherein dress material is fixed near the substance to be cut and a cutting blade is dressed while the substance is being cut for always achieving the high cutting quality, are proposed as described in Japanese Patent Laid-Open Nos. Hei 3-281170, 4-257405, etc. However, in the machining techniques, the dress material and the substance to be cut must be fixed at the same time; there are problems on workability and costs.

SUMMARY OF THE INVENTION

It is therefore an object of the invention to provide an ink jet head manufacturing method whereby cutting can be executed easily and accurately and high-quality ink jet heads can be provided.

According to the invention, the cutting step for determining the flow path end is divided into multiple steps in the thickness direction of the substance to be cut and the cutting feedrate in the upper region is set faster than or preferably to three times or more the cutting feedrate in the region containing the spouts, thereby shortening the step time, namely, improving throughput while the spout quality is maintained. At the time, the upper region is furthermore divided into n subregions for cutting, whereby the feedrate can be set to n times or more faster, enhancing the effect.

In the invention, to stably work a large number of heads with high quality and high accuracy, if silicon material is mainly cut, the cut volume per unit area·unit time of the blade, U, is set to $0.9\times10^{-5}$ ($mm^3\cdot sec/mm^2\cdot sec$) or more as the cutting condition for dressing or shaping the resin blade. If glass material is mainly cut, the cut volume per unit area·unit time of the blade, U, is set to $1.9\times10^{-6}$ ($mm^3\cdot sec/mm^2\cdot sec$) or more. Cutting is executed in the regions not containing the spouts and other portions under the conditions, whereby the blade can be dressed or shaped during the step.

In the invention, if silicon material is mainly cut, the cut volume per unit area·unit time of the blade, U, is set to less than $1.4\times10^{-5}$ ($mm^3\cdot sec/mm^2\cdot sec$) as the cutting condition in the region containing the spouts. If glass material is mainly cut, the cut volume per unit area·unit time of the blade, U, is set to less than $1.5\times10^{-6}$ ($mm^3\cdot sec/mm^2\cdot sec$). Cutting is executed in the regions containing the spouts under the conditions, whereby the end faces of the spouts can be provided with high accuracy and high quality.

In the invention, the spout face is cut in multiple steps and the region above the region containing the spouts is cut under the condition as claimed in claim 4 or 7 and the region containing the spouts is cut under the condition as claimed in claim 5 or 8, whereby after the blade is dressed or shaped when the region above the region containing the spouts is cut, the region containing the spouts can be cut with high accuracy, providing high-quality spouts.

In the invention, in multi-step cutting of three steps or more, the cut volume per unit area·unit time of the blade, U, as the lower region cutting condition is made lower than that as the upper region cutting condition, thereby preventing a swing of the blade from causing secondary failure on the upper cut face for improving the yield.

In the invention, grinding water (cooling water) does not directly abut the rotary cutting edge and is supplied to the grind region of the tip of the rotary cutting edge via the grind groove formed by the rotary cutting edge, whereby a swing of the blade is suppressed and the grinding water is efficiently supplied to the grind region, thus high-accuracy grinding can be performed, the nozzle quality becomes good, and uneven form change at the blade tip becomes hard to occur. A preferable result can be produced by setting the supply angle of the grinding water from 0° to 45° with respect to the feed direction of the rotary cutting edge.

In the invention, if grinding steps into which a grinding step is divided in a thickness direction of the substance to be ground are executed, grinding is executed in at least the region containing the spouts and the region below the region containing the spouts under the grinding water supply condition as claimed in claim 11 or 12, whereby high-accuracy grinding can be executed for providing high-quality spouts.

BRIEF DESCRIPTION OF THE DRAWINGS

FIG. 12 is an illustration of the comparison results of heads manufactured by the manufacturing methods of the invention and the cutting time, flow path length accuracy, and yield of conventional manufacturing methods;

FIG. 15 is an illustration of the cut volume per unit area·unit time, the spout quality, and the blade wear form when the substance to be cut is silicon;

FIG. 16 is an illustration of the cut volume per unit area·unit time, the spout quality, and the blade wear form when the substance to be cut is silicon; and FIG. 17 is an illustration of the cut volume per unit area·unit time, the spout quality, and the blade wear form when the substance to be cut is glass.

DETAILED DESCRIPTION OF THE PREFERRED EMBODIMENTS

Figure 1:
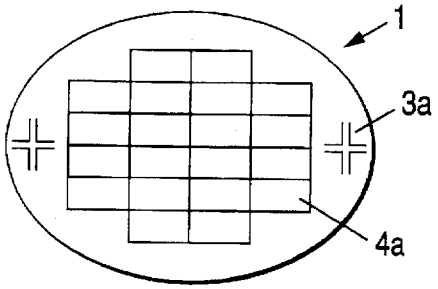
FIGS. 1A to 1G are process charts showing one embodiment of an ink jet head manufacturing method of the invention.
FIGS. 10A to 1OC are illustrations of a conventional grinding water supply method)
Figure 1:
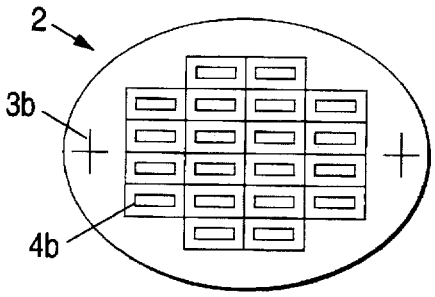
Figure 1:
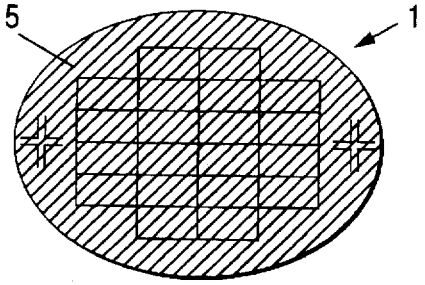
Figure 1:
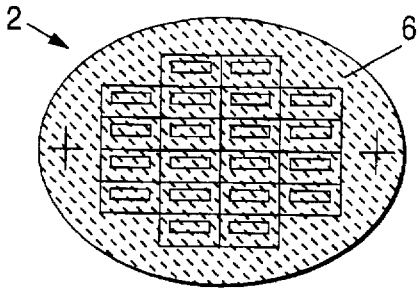
Figure 1:
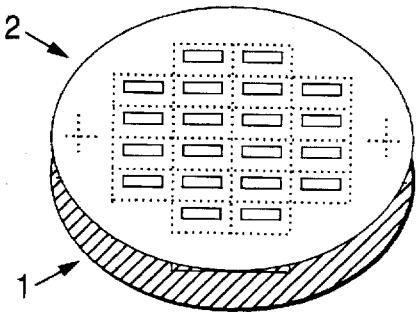
Figure 1:
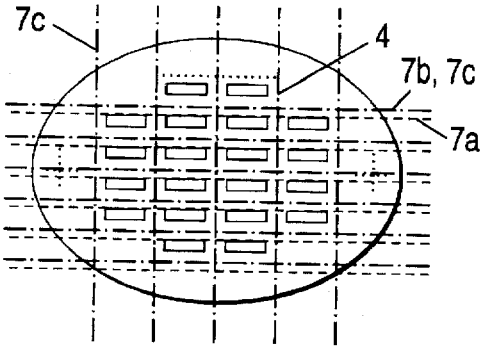
Figure 1:
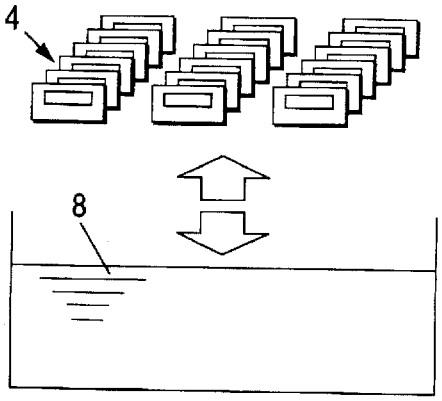
Figure 2:
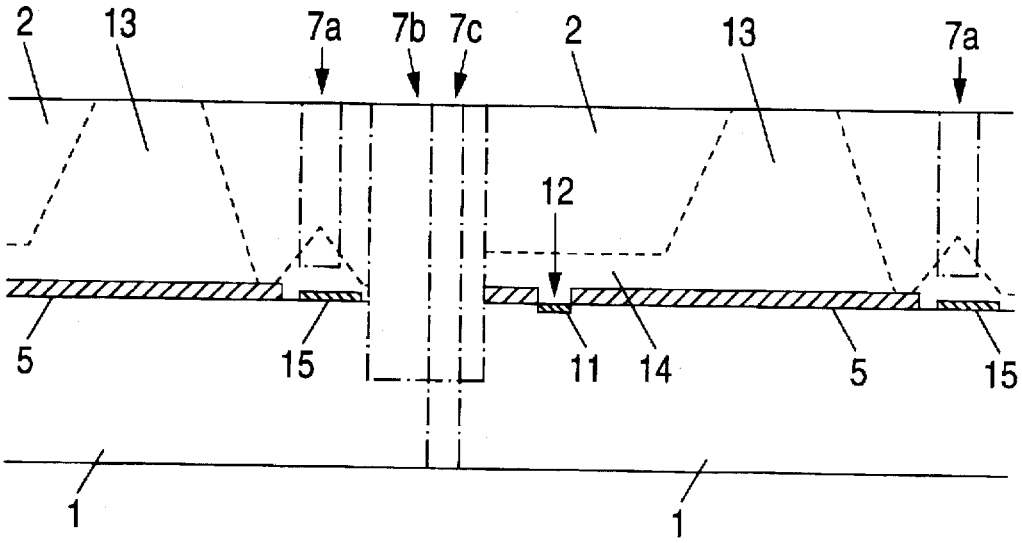
FIG. 2 is an enlarged sectional view showing one example of a wafer in head cutting and cutting and separating steps.

FIG. 1 is a process chart showing one embodiment of an ink jet head manufacturing method of the invention. FIG. 2 is an enlarged sectional view showing one example of a wafer in head cutting and cutting and separating steps, In the figures, numeral 1 is a heater wafer, numeral 2 is a channel wafer, numerals 3*a* and 3*b* are alignment marks, numerals 4, 4*a*, and 4*b* are head chips, numeral 5 is a photo-sensitive resin layer, numeral 6 is an adhesive, numerals 7*a*, 7*b*, and 7*c* are cutting positions, numeral 8 is a cleaning liquid, numeral 11 is a heater, numeral 12 is a pit, numeral 13 is an ink reservoir, numeral 14 is an ink flow path, and numeral 15 is a bonding pad.

In the step in FIG. 1A, the heater wafer 1 is manufactured. The heater wafer 1 is made of a silicon wafer and heaters 11, discrete electrodes and common electrodes (not shown), bonding pads 15, protective layers (not shown), etc., as many as the number of head chips 4*a* on the heater wafer side are formed on the silicon wafer by an LBI process, as shown in FIG. 2. Further, in the step in FIG. 1B, spin coating with a photo-sensitive polyimide resin is performed, then exposure and development to a desired pattern are executed for forming the photo-sensitive resin layer 5, and curing is performed, completing the heater wafer 1. For example, Probimide (registered trademark) manufactured by Ciba-Geigy, Pyralin PI2722 manufactured by Du-Pont, etc., can be used as the photo-sensitive polyimide resin. As shown in FIG. 2, the photo-sensitive resin layer 5 is not formed on the heater 11 or the bonding pad 15. The recess on the heater 11 becomes the pit 12 for regulating the form of bubbles generated by the heater 11. The alignment marks 3*a* are also formed on the heater wafer 1 during the step.

In the step in FIG. 1C, the channel wafer 2 is manufactured. The channel wafer 2 is also made of a silicon wafer and ink flow paths 14, ink reservoirs 13, etc., corresponding to the heaters 11 on the heater wafer 1 are formed by anisotropic etching, as shown in FIG. 2. Recesses are also formed in the parts corresponding to the bonding pads 15. Further, the alignment marks 3*b* are also formed. The channel wafer 2 is now complete.

Then, in the step in FIG. 1D, for example, the adhesive 6 with which a PET film is spin-coated is applied thinly and uniformly to the adhesive face of the channel wafer 2 by transfer.

Next, in the step in FIG. 1E, the heater wafer 1 manufactured in the steps (A) and (9) in FIG. 1 and the channel wafer 2 manufactured in the steps (C) and (D) in FIG. 1 are aligned with each other end bonded together. They are aligned using the alignment marks 3*a* and 3*b* previously patterned on the adhesive faces of the wafers; for example, they are aligned with high accuracy by an alignment device while the alignment is being observed under an infrared microscope. After the alignment and bonding, the two wafers are cured.

In the step in FIG. 1F, the resultant wafer is cut and cut and divided into the head chips 4. The step comprises a cutting step for cutting the channel wafer 2 at the cutting positions 7a to expose the bonding pads 15 on the heater wafer 1, a dicing step for cutting at the cutting positions 7b to form the spout face of the two wafers bonded in FIG. 1E and defining the flow path length, and a cutting-away step for cutting at the cutting positions 7c and dividing into head chips. In FIG. 2, the cut parts are indicated by dot-dash lines. Although the wafer is cut so as to form grooves in the dicing step, it may be cut including the cutting-away step. In the step, the wafer is cut and divided into head chips 4.

The step in FIG. 1G is a step for cleaning the head chips into which the wafer is divided in the step in FIG. 1F in the cleaning liquid 8. If chips, dust, etc., generated by the cutting in FIG. 1F remains in the head chips 4, ink spout failure, etc., is caused, lowering the picture quality. Thus, the chips, dust, etc., is washed away in the step for cleaning the head chips 4.

Figure 3:
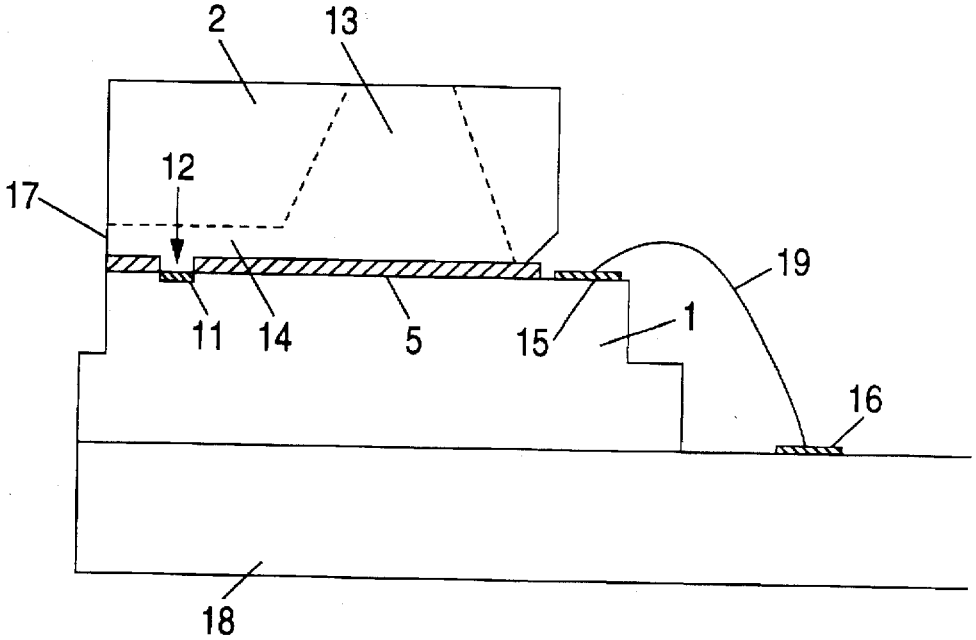
FIG. 3 is an illustration of one example of ink jet head.

FIG. 3 is an illustration of one example of ink jet head. Parts identical with or similar to those previously described with reference to FIGS. 1 and 2 are denoted by the same reference numerals in FIG. 3 and will not be discussed again. Numeral 16 is a bonding pad, numeral 17 is a spout, numeral 18 is a fixing board, and numeral 19 is bonding wire. A head chip 4 manufactured by the process as shown in FIG. 1 is die-bonded onto the fixing board 18 and the bonding pad 16 on a printed wiring board (not shown) on the fixing board 18 and a bonding pad 15 on a heater wafer 1 are electrically connected by the bonding wire. After this, connection such as sealing end joint is made as required, completing an ink jet head.

Figure 4:
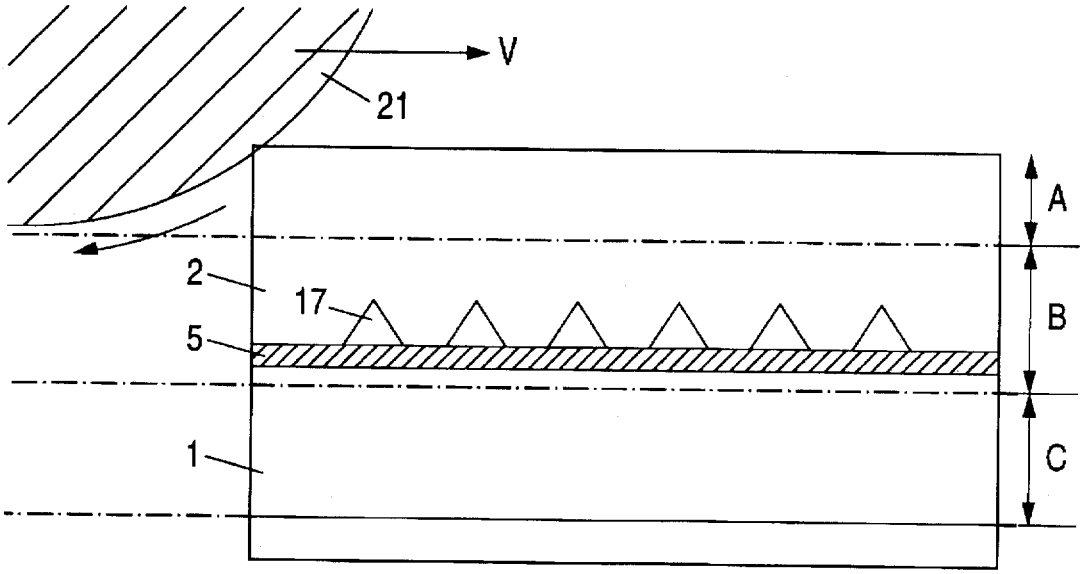
FIG. 4 is a front view showing a spout cutting example in a dicing step.

FIG. 4 is a front view showing a spout cutting example in the dicing step, wherein numeral 21 is a blade. In the ink jet head manufacturing process shown in FIG. 1, the former dicing step for forming the spout face and defining the flow path length comprises one step. However, in the embodiment, for example, the region in the cut depth direction Is divided into three subregions and cutting is performed three times. Region B is a cut region containing the spouts. Assume that the region above the region B is region A and that the region below the region B is region C.

Pot forming the spout face and determining the flow path length, cutting the region B requires high accuracy and high quality. Thus, feedrate v2 when the region B is cut is a rate for cutting head material with high quality. Feedrate v1 when the region A is cut is set, for example, to three times the feedrate v2 when the region B is cut. Feedrate v3 when the region C is cut is the same as the feedrate v2 when the region B is cut. Since no spouts are contained, the feedrate v3 when the region C is cut can be set faster. However, if the region C is cut at faster feedrate, the blade may swing, affecting the cut face of the region A or B. Thus, the feedrate v3 when the region C is cut is set to the feedrate v2 when the region B is cut or less, whereby affecting the upper cut face can be prevented and the yield can be improved.

Specifically, when the head material comprises essentially of silicon, the feedrate v2 for cutting the region B with high quality may be set to 2.0 mm/set, for example. The feedrate v1 may be set to 6.0 mm/sec (three times the feedrate v2). The feedrate v3 may be the same as the feedrate v2, mm/sec. Cut depths in the cutting substeps, h1, h2, and h3, are 350, 350, and 400 μm respectively. The blade 21 is a resin blade having a diameter of 52 mm with diamond of an extremely small diameter (particle size No. 3000) coated with resin; the number of revolutions is 30,000 rpm.

Assuming that the number of revolutions of the blade is P (revolutions/set), that the cutting edge radius is R (mm), that the cutting edge width is W (mm), that the feedrate is V (mm/sec), and that the cut depth is H (mm), cut volume per unit area·unit time of the cutting edge, $U=v\times H\times W/(2\times\pi\times R\times P\times W)$ ($mm^3\cdot sec/mm^2\cdot sec$) is considered. In the specific example given above, the cut volume of the region A, $U_1=2.57\times10^{-5}$, the cut volume of the region B, $U_2-8.58\times10^{-6}$, and the cut volume of the region C, $U_3=1.03\times10^{-5}$.

Figure 5:
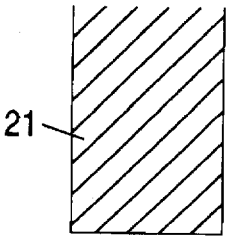
FIGS. 5A to 5C are illustrations of the tip sectional form of a blade.
Figure 5:
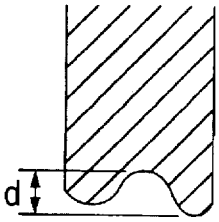
Figure 5:
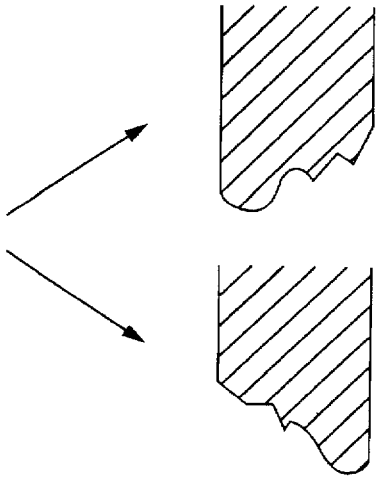

Generally, if cutting is continued under a high-quality cutting condition using the blade 21 heavily worn such as a resin blade, for example, with cut volume $U<1.0\times10^{-5}$ ($mm^3\cdot sec/mm^2\cdot sec$) for silicon, the nose is worn out to an uneven form. FIG. 5 is an illustration of the tip sectional form of the blade. FIG. 5A shows the initial tip sectional form of the blade. When cutting is continued, the form changes as shown in FIGS. 5B and 5C. Wear as shown in FIG. 5B is caused greatly by load and heat at the blade tip; if the cut depth is deep, it becomes more remarkable. When the blade tip becomes the sectional form as shown in FIG. 5C, the force that the blade receives from the substance being cut leans to one side, and the blade at cutting produces a bend.

Figure 6:
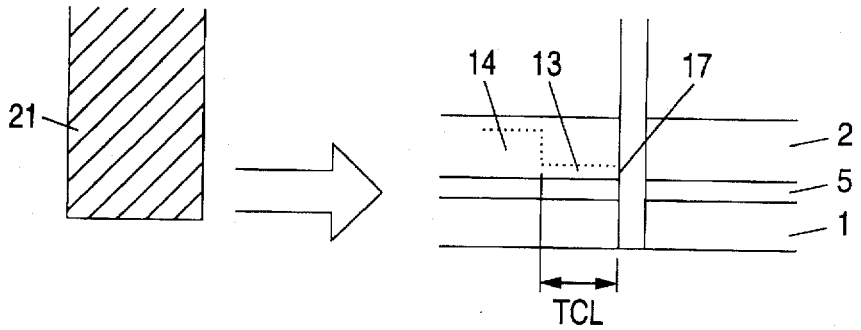
FIGS. 6A end 6B are illustrations of the tip forms of the blade and cut face bends.
Figure 6:
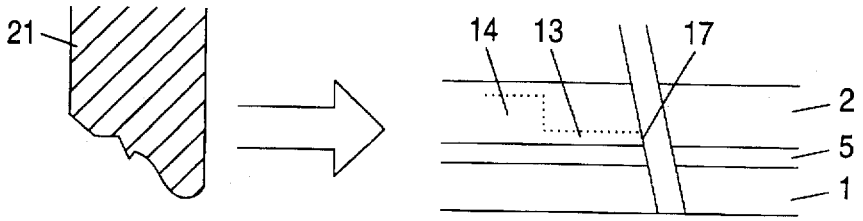

FIG. 6 is an illustration of the tip forms of the blade and cut face bends. As shown in FIG. 6A, when the blade has the initial tip sectional form, the force that the blade receives from the substance being cut is uniform, thus the blade can cut the substance straightly. However, when the blade has the tip sectional form as shown In FIG. 6B, the blade bends at cutting end cuts the substance slantingly. The blade bend extends to about 50 μm at the maximum, producing variations in the accuracy of the flow path length (TCL).

Generally, to suppress the above-mentioned blade bend, the blade jump amount from a flange (blade holding jig) may be lessened and the blade width may be increased. However, the blade jump amount cannot be made less than the cut depth; in the specific example given above, two general silicon wafers are bonded together, thus it is hard to set the blade jump amount to 1 mm or less. If the blade width is increased, the cut width widens and when a large number of head chips are cut out from the wafer, the head yield decreases, leading to a rise in the cost of manufacturing the head chips. A method containing a step of truing the blade form each time given cutting is executed is also possible. However, in this method, several truings are required in one wafer and alignment with the substance being cut is required in each truing, worsening productivity remarkably.

Figure 7:
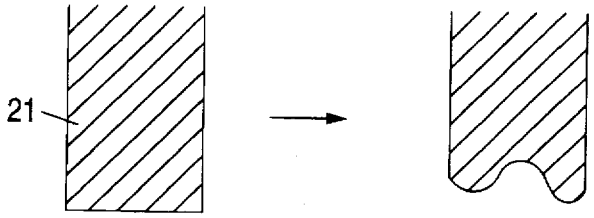
FIGS. 7A and 7B are illustrations of blade feedrate change and the tip forms of the blade.
Figure 7:
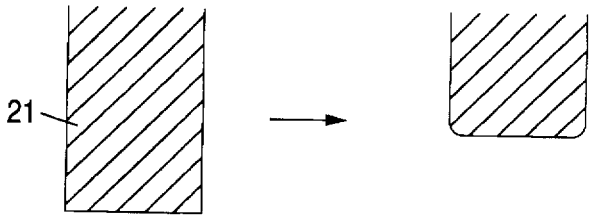

FIG. 7 is an illustration of blade feedrate change and the tip forms of the blade. As described with reference to FIG. 5, wear as shown in FIG. 7A is shown at the feedrate of the blade achieving the high cutting quality, If the blade feedrate is set to about three times or more, the wear amount increases, but the form becomes uniform, as shown in FIG. 7B. This is because diamond particle loss and resin part wear are accelerated due to excessive cut resistance. Even the blade once worn on one side cuts a substance at fast feedrate, whereby projections worn on one side are evened and given form shaping is enabled. At the same time, new diamond particles and pockets are formed, producing the dress effect. If the feedrate at the time is a given rate or higher, load imposed on the blade becomes too large, causing large swing of the blade or damage to the blade. This is affected greatly by the cut depth, etc.,; in the same condition, about ten times the feedrate becomes a limit.

By applying the feedrate selected considering such characteristics, shortening the cutting time, high accuracy, and high quality are achieved in all cutting steps of the wafer. That is, when the spout face was formerly cut one time, the cut depth is deep, thus the wafer needs to be cut at about a third the feedrate in the region 9 to cut it with high accuracy and high quality. However, since some region having no spouts is cut at fast feedrate as in the embodiment, the cutting time can be shortened as a whole and the accuracy and quality of the region having the spouts can be maintained.

Figure 8:
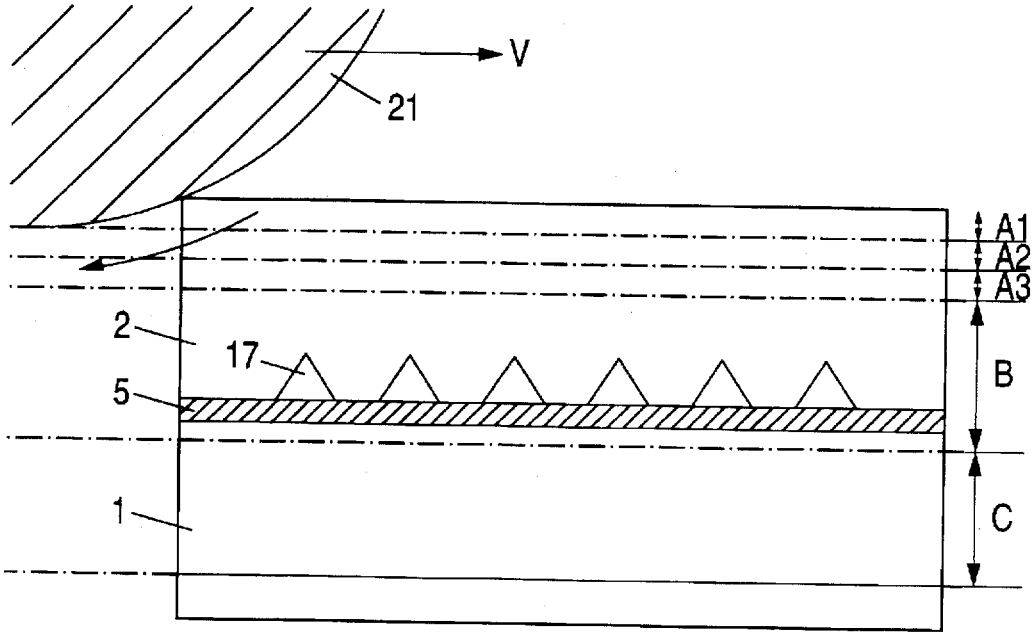
FIG. 8 is a front view showing another spout cutting example in the dicing step.

FIG. 8 is a front view showing another spout cutting example in the dicing step. In this example, the region above the region B containing the spouts 17 is furthermore divided into three subregions. The three upper regions A1, A2, and A3 are cut at feedrate of 20 mm/sec, for example, whereby the whole cutting time can be shortened. Since high-speed cutting is performed with shallow cut depth, form shaping of the blade becomes better and stable as compared with the example shown in FIG. 4. For example, assuming that the blade diameter is 50 mm, that the number of revolutions is 40,000 rpm, and that the cut depth is 100 μm, cut volume per unit area·unit time of the cutting edge, $U_1=1.91\times10^{-5}$ ($mm^3\cdot sec/mm^2\cdot sec$).

Figure 9:
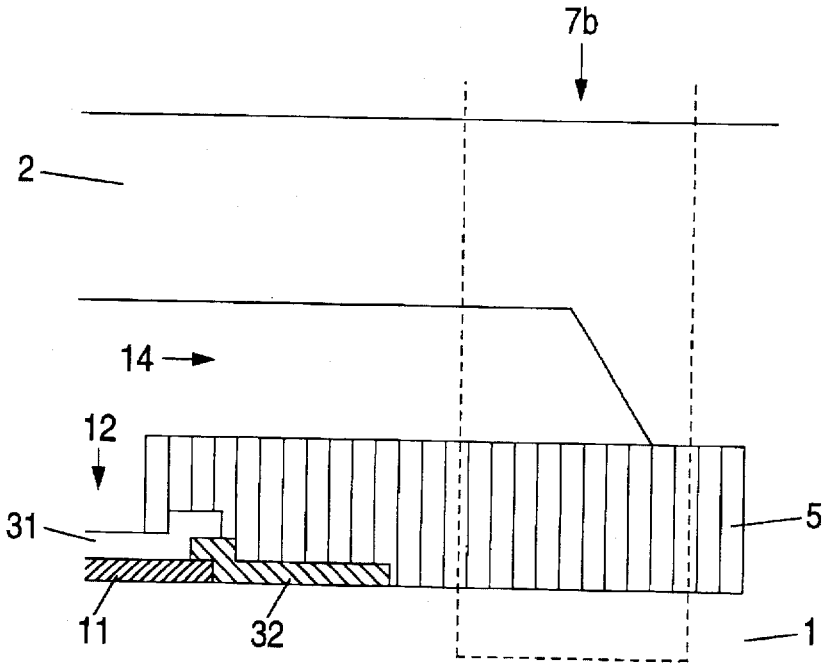
FIG. 9 is an enlarged sectional view showing an example of a dicing work part of a wafer)

FIG. 9 is an enlarged sectional view showing an example of a dicing work part of a wafer. Parts identical with or similar to those previously described with reference to FIG. 2 are denoted by the same reference numerals in FIG. 9. Numeral 31 is a heater protective film and numeral 32 is a common electrode. When the spout face is formed and the flow path length is determined by dicing work, the form of channel wafer 2 in the blade width direction on the cutting line may differ as shown in FIG. 9. If the part of such form is cut, wear of the blade on one side is promoted. However, if the cutting method as shown in FIG. 8 is used, the blade form is shaped to a good condition before the region containing the spouts is cut, thus stable work can also be executed when the region containing the spouts is cut. This eliminates the need for extra space for lengthening the flow path for cutting, leading to improvement in the head yield.

In the example in FIG. 8, the cut depths of the regions B and C are 450 and 350 μm. The cut volumes per unit area·unit time of the cutting edge in the regions B and C, $U_2=8.60\times10^{-6}$ and $U_3=6.69\times10^{-6}$ ($mm^3\cdot sec/mm^2\cdot sec$). Thus, load on the blade in the cutting step of the region C can be lessened, preventing swing of the blade from interfering with the face formed by the upper cutting, defects around the spouts being decreased. The number of revolutions and the feedrate of the blade can also be changed as a method of lessening the load on the blade in the cutting step of the region C. Changing the number of revolutions requires the change/stable time, prolonging the head manufacturing process time. Preferably, the method of changing the cut depth or the feedrate as described above is used.

As described above, wear as shown in FIG. 5B is caused greatly by load and heat at the blade tip. Cutting with a cutting edge as described above is also called grinding end heat is generated in grind regions. Thus, grinding water (cooling water) is supplied to the grind regions for preventing heat from causing wear. However, wear at the center in the blade width direction as shown in FIG. 5B is caused greatly by insufficient supply of cooling water.

Figure 10:
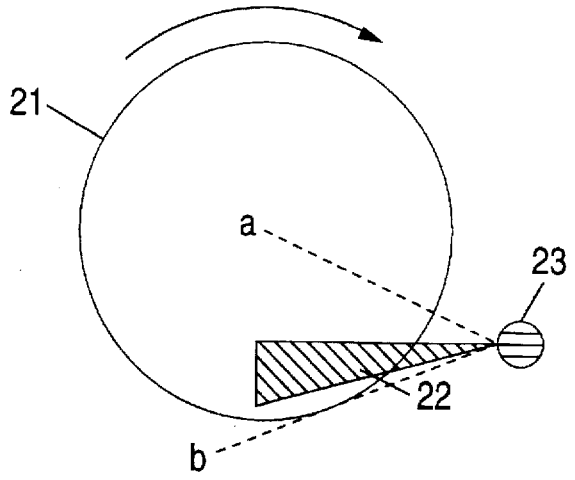
FIG. 10 (A) PRIOR ART
Figure 10:
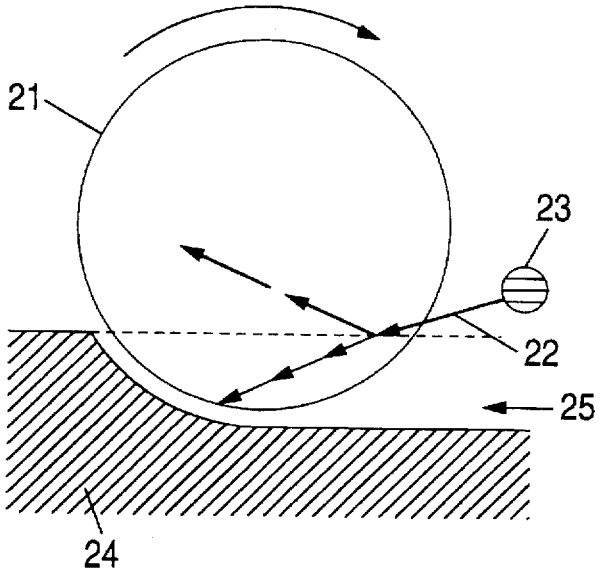
FIG. 10 (B) PRIOR ART
Figure 10:
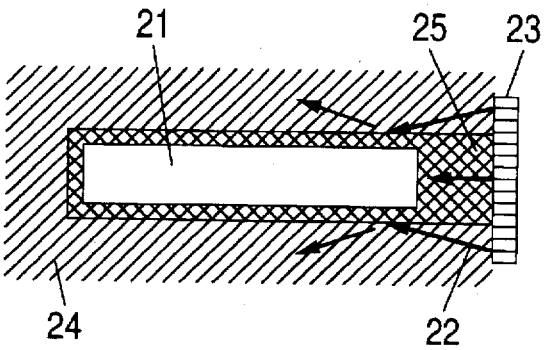
FIG. 10 (C) PRIOR ART

FIG. 10 is an illustration of a conventional grinding water supply method; FIG. 10A is a schematic drawing of the supply method, FIG. 10B is a sectional view of a grind part, and FIG. 10C is a plan view Of the grind part. In FIG, 10, numeral 21 is a blade, numeral 22 is grinding water, numeral 23 is a grinding water nozzle, numeral 24 is a substance to be ground, and numeral 25 is a grind groove. The blade 21 is fed from right to left in the figure. In the conventional supply method of the grinding water 22, the grinding water 22 is supplied so that it hits directly the blade 21 between a line a connecting the grinding water nozzle 23 and the center of the blade 21 and a line b tangent to the grinding water nozzle 23 and the outer peripheral surface of the blade 21, as shown in FIG. 10A, for well supplying the grinding water 22 to the side faces of the blade 21. If a blade with diamond of an extremely small diameter as described above, namely, a blade with less uneven side faces is used for cutting in a condition in which the blade less swings, a sufficient space to supply the grinding water 22 does not exist between the substance to be ground and the blade 21. Thus, in the method shown in FIG. 10A, sufficient grinding water 22 is not supplied to the grind work past at the tip of the blade 21 and wear is prone to occur at the center in the blade width direction as shown in FIG. 5B, as described above. This trend becomes more remarkable as the grind groove deepens. As shown in FIGS. 10B and 10C, in the conventional supply method of the grinding water 22, the grinding water 22 is made to hit directly the blade 21, thus most of the grinding water 22 scatters on the substance being ground 24 and the grinding water 22 is not sufficiently supplied to the grind part. Shortage of the grinding water 22 may also be compensated by an increase in the flow quantity of the grinding water 22; however, since the grinding water 22 is made to hit directly the blade 21, extra load is imposed on the blade 21, causing the blade 21 to swing, resulting in lowering the grinding quality.

Figure 11:
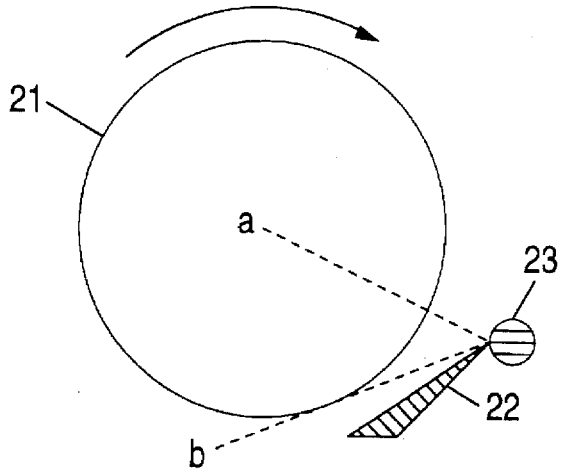
FIGS. 11A to 11C are illustrations of an example of a grinding water supply method of the invention.
Figure 11:
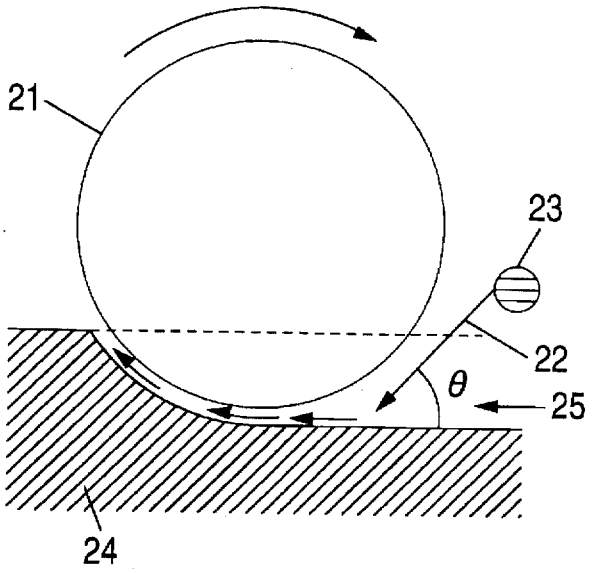
Figure 11:
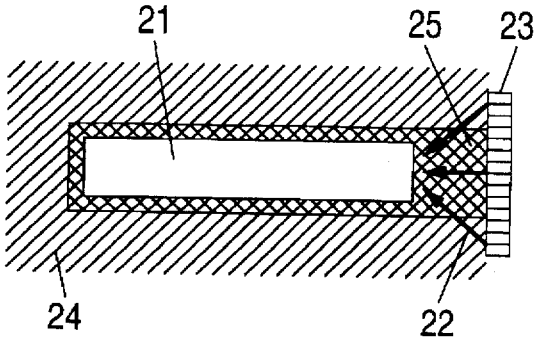

FIG. 11 is an illustration of an example of a grinding water supply method of the invention; FIG. 11A is a schematic drawing of the supply method, FIG. 11B is a sectional view of a grind part, and FIG. 11C is a plan view of the grind part. Parts identical with or similar to those previously described with reference to FIG. 10 are denoted by the same reference numerals in FIG. 11. A blade 21 is fed from right to left in FIG. 11 as in FIG. 10. In the supply method of grinding water 22 according to the invention, the grinding water 22 is not directly supplied to the blade 21 and is supplied to the grind part via a grind groove 25 formed by grinding. By supplying the grinding water 22 in such a manner, the amount of the supplied grinding water 22 scattering on the surface of a substance being cut 24 lessens and the grinding water 22 is sent to the grind part along the grind groove 25 as the blade 21 turns. Thus, sufficient grinding water 22 can be supplied to the grind part, making wear as shown in FIG. 5B hard to occur and providing good grinding quality.

In the supply method of the grinding water 22 according to the invention, preferably the supply angle of the grinding water 22 with the feed direction of the blade 21, namely, the supply angle of the grinding water 22 with the bottom of the grind groove 25, θ, is set to 0° to 45°. More preferably, it is set to 0° to 30°, whereby a necessary minimum amount of grinding water can provide good grinding quality.

FIG. 12 is an illustration of the comparison results of heads manufactured by the manufacturing methods of the invention and the cutting time, flow path length accuracy, and yield of conventional manufacturing methods. A method of forming a spout face by one cutting and a method of simply cutting at multiple (three) steps are used as the conventional head manufacturing methods. A conventional supply method as shown in FIG. 10 is used as the grinding water supply method. As the manufacturing methods of the invention, "embodiment 1 of the invention" is the method shown in FIG. 4 wherein the region is divided into three subregions for cutting and "embodiment 2 of the invention" and "embodiment 3 of the invention" are the method shown in FIG. 8 wherein the upper region is furthermore divided into three subregions for cutting. The "embodiment 2 of the invention" and "embodiment 3 of the invention" differ in grinding water supply method. The grinding water supply method of the invention as shown in FIG. 11 is used in the "embodiment 1 of the invention" and "embodiment 2 of the invention." The grinding water supply angle θ is 25°. The conventional grinding water supply method as shown in FIG. 10 is used in the "embodiment 3 of the invention." In the examples and embodiments, the grinding water flow quantity is 1.5 l/min.

FIG. 12 shows the cutting time, the flow path length accuracy, and the yield from the spout quality when cutting is executed by each method. The flow path length accuracy of the evaluation result contains alignment accuracy within about 2 μm. As seen in Table 12, it is clear that the flow path length accuracy and yield are greatly improved and the cutting time is also shortened in the three methods of the invention as compared with the conventional examples. That is, the flow path length accuracy is greatly improved, the cutting time is also shortened, and the yield is also improved by using the cutting method of the invention from comparison between "conventional 1-step example" and "conventional multi-step example" and "embodiment 3 of the invention." The yield can be greatly improved by changing the grinding water supply method from comparison between "embodiment 2 of the invention" and "embodiment 3 of the invention." Thus, if only either of the cutting method and grinding water supply method is used, great improvement is made as compared with the conventional examples; better cutting can be executed by using both the cutting method and grinding water supply method of the invention like "embodiment 1 of the invention" and "embodiment 2 of the invention."

Figure 13:
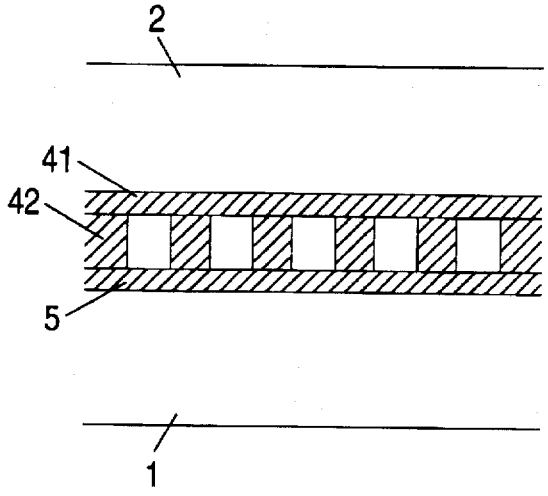
FIGS. 13A and 13B are structural drawings of another head structure.
Figure 13:
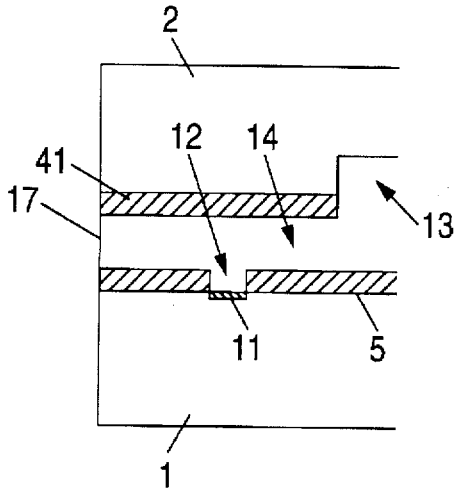

FIG. 13 is a structural drawing of another head structure; FIG. 13A is a front view and FIG. 13B is a sectional view. Parts identical with or similar to those previously described with reference to FIGS. 1 to 4 are denoted by the same reference numerals in FIG. 13 and will not be discussed again. Numeral 41 is a photo-sensitive resin layer and numeral 42 is a partition.

A heater wafer 1 is made of a silicon substrate and a heater 13 and electrodes, signal circuitry, etc., (not shown) are formed by a known LSI technology. A photo-sensitive resin layer 5 with polyimide is formed thereon, and pits 12 and bonding pads, etc., (not shown) are patterned. A channel wafer 2 functions as a top board in the example; a photo-sensitive glass plate is used. The channel wafer 2 is formed with an ink reservoir 13 and a photo-sensitive resin layer 41 is formed and a photo-sensitive resin is patterned thereon, forming the partitions 42. Next, the heater wafer 1 and the channel wafer 2 are bonded together and an ink flow path 14 is formed. The resultant wafer is cut and separated into head chips and ink jet heads are manufactured. Spouts 17 appear on the cut face.

Figure 14:
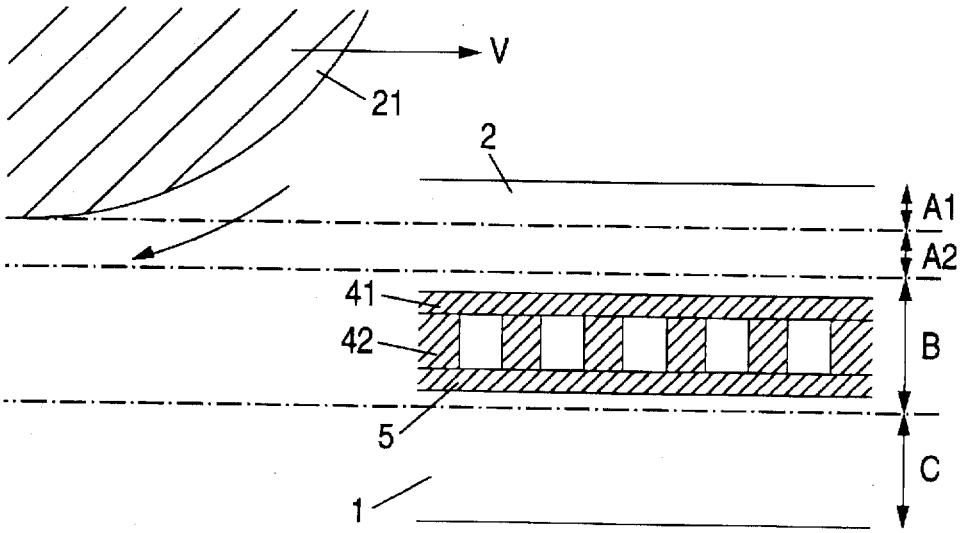
FIG. 14 is a front view showing a spout cutting example in a dicing step in the head structure in FIG. 13.

FIG. 14 is a front view showing a spout cutting example in a dicing step in the head structure in FIG. 13. In this example, the cut face is divided into region B containing the photo-sensitive resin layer 5, a region above the region B, and region C below the region B. Further, the region above the region B is divided into two regions A1 and A2 and cutting is executed for each region. The region division factor is not limited to it. Since photo-sensitive glass is used as the channel wafer 2 in the head structure in the example, the region B is cut under a condition appropriate for photo-sensitive glass. The regions A1 and A2 are cut at feedrate v1 faster than feedrate v2 in cutting the region B. The cut depth is made shallow by dividing the region and the feedrate v1 in the regions A1 and A2 can be made about 10 times the feedrate v2 in the region B. A blade can be dressed by cutting at such feedrates. Since the heater wafer 1 is made of a silicon substrate, the region C is cut at a feedrate appropriate for cutting silicon, whereby the effect of swing of the blade, etc., on the already cut face can be reduced.

Specifically, for example, the cut depth of each of the regions A1 and A2 is 200 μm, that of the region B is 450 μm, and that of the region C is 550 μm. A blade having a diameter of 52 mm called a metal region of diamond particle size No. 600 is used for cutting at the rotation speed 40,000 rpm. At this time, the feedrate v1 when the regions A1 and A2 are cut may be set to 1.0 mm/sec ($U_1=1.84\times10^{-6}$), the feedrate v2 when the region B is cut may be set to 0.1 mm/sec ($U_2=4.13\times10^{-7}$) appropriate for photo-sensitive glass, and the feedrate v3 when the region C is cut may be set to 1.0 m m/set ($U_3=5.05\times10^{-6}$) appropriate for silicon.

As shown in the two examples given above, the feedrate for cutting with high quality varies depending on not only the substance to be cut (silicon, glass, etc.,), but also the resin type of blade, the diamond extremely small diameter, the cut depth, the number of revolutions of the blade, and the cooling water (grinding water) supply method. The feedrate appropriate for the substance to be cut in the invention refers to the upper limit rate allowing for a margin within the range of feedrates that can be selected from the quality of spout surroundings if the above-mentioned conditions are kept constant. If cutting is executed at the feedrate thus selected, crushed (or round-edge) diamond extremely small diameter on the blade surface is moderately lost and new diamond extremely small diameter is exposed, thus high dicing quality can be provided within a given range.

The blade shaping/dressing condition in the invention is to forcibly cause diamond extremely small diameter to be lost and shape the blade form for the moderate diamond extremely small diameter loss condition described above. For example, these are determined substantially by the material to be cut and the cut volume per unit area·unit time of a resin blade determined by the blade diameter, the number of revolutions, the feedrate, and the cut depth, U.

FIGS. 15 to 17 are illustrations of the cut volume per unit area· unit time, the spout quality, and the blade wear form; FIGS. 15 and 16 are applied when the substance to be cut is silicon and FIG. 17 is applied when the substance to be cut is glass. These tables list the evaluation results about the spout quality and blade form change when the cut volume per unit area·unit time, U, is changed. Here, good spout quality indicates that an average spout does not contain loss or defect of 2 μm or less, and the decision criterion as a good blade wear form is that the deformation amount after cut length of 200 cm (d in FIG. 5) is 50 μm or less. This determination is based on the fact that, for example, if the deformation amount of the wear form of a blade 200 μm thick is exceeded, the probability that the sectional form of the blade will become the form as shown in FIG. 5C becomes high.

When the substance to be cut is silicon, a blade with diamond particle size No. 3000 and blade width 200 μm is used, the jump amount from a flange, a blade retainer is 1.5 mm, and grinding water is supplied in an amount of 1.5 l/min with the angle of the grinding water efficiently hitting a cut part, for example, the supply angle shown in FIG. 11B, θ, as 25°. The diamond particle size of the blade greatly affects the spout quality. If the substance to be cut is silicon, the particle size in the range of Nos. 1000 to 5000 is selected to provide good spout quality. Even if the particle sizes differ, the results shown in Tables 15 and 16 become similar in the diamond particle size range mentioned above by sliding average loss requirement quality of spouts.

As shown in FIGS. 15 and 16, when the substance to be cut is silicon, the condition for providing good spout quality is $U=1.4\times10^{-5}$ ($mm^3\cdot sec/mm^2\cdot sec$) or less; preferably it is U U=2 to $7\times10^{-6}$ ($mm^3\cdot sec/mm^2\cdot sec$). The feed accuracy with which the blade wear form becomes good is $0.9\times10^{-5}$ ($mm^3\cdot sec/mm^2\cdot sec$); preferably it is 1.5 to $3.0\times10^{-5}$ ($mm^3\cdot sec/mm^2\cdot sec$). In the tables, XX under the columns of the spout quality and the blade wear form denotes that the blade is broken due to excessive cutting resistance, and OX means that good quality is shown in the initial state, but the quality or form worsens with the time because the blade is crushed.

From FIGS. 15 and 16, evaluation of the spout quality and blade wear form depending on the value of U may be reversed in regions around U=0.9 to $1.8\times10^{-5}$ ($mm^3\cdot sec/mm^2\cdot sec$) and U U=4.3 to $6.4\times10^{-5}$ ($mm^3\cdot sec/mm^2\cdot sec$). This is because the value of U depends on the number of revolutions of the blade, the cut depth, the feedrate, and the blade diameter and thus a large number of combinations of these values exist for one value of U. In the regions, the spout quality can be provided in one combination thereof and the bladewear form can be made good in another combination. Of the values, the feedrate and the cut depth affect more greatly than other factors; particularly, the feedrate greatly affects the blade wear form. Thus, if values of U are similar, shallow cut depth and faster feedrate would have an effect on shaping the blade form.

The example shown in FIG. 17 in which the substance to be cut is glass material shows substantially similar trend to that in the example in which the substance to be cut is silicon; the value of U becomes about a tenth. The used blade is a blade 300 μm wide with diamond particle size No. 600 and other conditions such as the jump amount from the flange and cooling water are similar to those in the example in which the substance to be cut is silicon. The evaluation shown in Table 17 is an evaluation when grooved photo-sensitive glass is cut, and differs from an evaluation for the actual head form. Whether or not the spout quality is good is determined based on the fact that the photo-sensitive glass groove does not contain loss of 10 μm or more; the actual head assumes the head structure as shown in FIG. 13 and glass does not exist near the spouts, thus the quality required from the spout directionality becomes mild.

$U=1.5\times10^{-6}$ ($mm^3\cdot sec/mm^2\cdot sec$) or less is selected for cutting the region containing the spouts and $U=1.9\times10^{-6}$ ($mm^3\cdot sec/mm^2\cdot sec$) or more is selected for the blade form shaping condition from Table 17.

The blade thickness is not ideally related to the cut volume per unit area·unit time, U. In fact, if the blade becomes extremely thick, cooling water supply to the cut work part becomes uneven, causing cutting failure. If the blade is extremely thin, the blade swings, causing quality degradation. Thus, normally a blade about 0.05–1.0 nm wide is selected.

This invention is not limited to the above-mentioned examples or embodiments and the blade feed direction, etc., can be selected as desired. For the triangular spout form as shown in FIGS. 4 and 8, the blade turn direction is made upward from downward for the blade feed direction particularly in the cut region B containing the spouts, whereby defect caused by loss on the slope of the spout can be improved. The head structure is not limited to the above-mentioned structures either and the invention can be applied to ink jet heads of various structures. For example, it can also be applied to a structure in which only the flow path length is defined by cutting and an additional orifice plate is pasted.

We have discussed the example in which cutting for shaping the blade form is applied to a part of multi-step cutting on the spout face, bun the invention is not limited to the example. For example, the conventional 1-step cutting may be applied to the spout face, the cutting position 7*a* for exposing the wire bond part shown in FIG. 2 may be cut in the cutting condition for shaping the blade form and the blade form may be shaped, then the spout face may be cut.

According to the invention, a large number of heads can be stably manufactured with high accuracy and high quality without requiring additional steps, etc., and the manufacturing time can also be shortened.

What is claimed is:

1. A method of manufacturing an ink jet head having an ink flow path and a spout communicated with said ink flow path for jetting ink drops, said spout and a surrounding face thereof being formed on a substance used in manufacturing the ink jet head, the method comprising the step of:

cutting said substance to define an ink flow path length with a rotary cutting edge, wherein said cutting step is divided into multiple steps in a thickness direction of said substance, and a relationship between $V_A$ and $V_B$ satisfies $V_A>V_B$; and wherein said $V_A$ and $V_B$ are relative feed rates of said rotary cutting edge to said substance to be cut in regions A and B of said substance, and said region B is a region containing said spout and said region A is a region not containing said spout and positioned above said region B.

2. The method of claim 1, wherein the relationship between $v_A$ and $v_B$ satisfies $v_A\geqq3\times v_B$.

3. The method of claim 1, wherein said region A is furthermore divided into multiple regions for cutting.

4. The method of claim 1, wherein said substance to be cut consists essentially of silicon, said region A is cut under conditions which include cutting said substance while a resin cutting edge with diamond particles fixed in resin is being turned, wherein the number of revolutions is P (revolutions/sec), a cutting edge radius is R (mm), a cutting edge is W (mm), a feedrate is V (mm/sec), and a cut depth is H (mm), and the cutting includes at least one cutting step of cutting the silicon under a condition wherein cut volume per unit area· unit time of said cutting edge, $U=V\times H\times W/(2\times\pi\times R\times P\times W)$ is $0.9\times10^{-5}$ ($mm^3\cdot sec/mm^2\cdot sec$) or more.

5. The method of claim 4, further including cutting region B under the condition of cutting said substance while a resin cutting edge with diamond particles fixed in resin is being turned, wherein a region consisting essentially of silicon and containing said spout is cut under a condition wherein cut volume per unit area·unit time of said cutting edge, U, is less than $1.4\times10^{-5}$ (mm3·sec/$mm^2$·sec).

6. The method of claim 1, wherein when said substance to be cut consisting essentially of glass, and said region A is cut under the condition of cutting said substance while a resin cutting edge with diamond particles fixed in resin is being turned, and the cutting includes at least one cutting step of cutting the glass material under a condition wherein a cut volume per unit area·unit time of said cutting edge, U, is $1.9\times10^{-6}$ ($mm^3\cdot sec/mm^2\cdot sec$) or more.

7. The method of claim 6, further including cutting region B under the condition of cutting said substance while a resin cutting edge with diamond particles fixed in resin is being turned, wherein a region comprising essentially glass material and containing said spout is cut under a condition in which cut volume per unit area·unit time of said cutting edge, U, is less than $1.5\times10^{-6}$ ($mm^3$·sec/$mm^2$·sec).

8. The method of claim 1, wherein said substance is divided into three or more regions in a thickness direction thereof, said substance including a region B containing said spout, a region A not containing said spout and positioned above said region B, and a region C not containing said spout and positioned below said region B, and a cut volume per unit area·unit time of the cutting edge in cutting process, U, is set to $U_C \leqq U_B < U_A$.

9. The method of claim 1, wherein said cutting is executed by a grinding step divided into a plurality of grinding steps in a thickness direction of said substance to be ground, and said substance includes a region B containing said spout, a region A not containing said spout positioned above said region B, and a region C not containing said spout positioned below said region B, and the grinding steps of at least said regions B and C are executed under grinding water supply condition of grinding while a rotary cutting edge is being turned, wherein grinding water is supplied to a grind region of said rotary cutting edge via a grind groove formed by said rotary cutting edge without directly abut said rotary cutting edge.

10. The method of claim 1, wherein said cutting is executed by a grinding step divided into a plurality of grinding steps in a thickness direction of the substance to be ground, and the substance includes a region B containing said spout, a region A not containing said spout and positioned above said region B, and a region C not containing said spout and positioned below said region B, and the grinding steps of at least said regions B and C are executed under the grinding water supply condition of supplying said grinding water at an angle of 0° to 45° with respect to a feed direction of said rotary cutting edge.

* * * * *

UNITED STATES PATENT AND TRADEMARK OFFICE

CERTIFICATE OF CORRECTION

PATENT NO. : 5,680,702

DATED : October 28, 1997

INVENTOR(S) : Masaki KATAOKA

It is certified that error appears in the above-indentified patent and that said Letters Patent is hereby corrected as shown below:

In claim 1, Column 12, line 27, "feed rates" should read -- feedrates --.

In claim 9, Column 14, line 7, "abut" should read -- abutting --.

Signed and Sealed this

Ninth Day of June, 1998

*Attest:*

*Attesting Officer*

Bruce Lehman

BRUCE LEHMAN

*Commissioner of Patents and Trademarks*